US005990791A

United States Patent [19]

Andreasen et al.

[11] Patent Number: 5,990,791

[45] Date of Patent: Nov. 23, 1999

[54] ANTI-THEFT DETECTION SYSTEM

[75] Inventors: Howard P. Andreasen, Cave Creek, Ariz.; William B. Spargur, 1505 Alameda Padre Serra, Santa Barbara, Calif. 93103

[73] Assignee: William B. Spargur, Santa Barbara, Calif.

[21] Appl. No.: 08/956,138

[22] Filed: Oct. 22, 1997

[51] Int. Cl.[6] ..... G08B 13/14

[52] U.S. Cl. ..... 340/572.1; 340/572.2; 340/572.4; 340/572.7; 340/572.8; 340/571; 340/568.1

[58] Field of Search ..... 340/572, 571, 340/568, 551

[56] References Cited

U.S. PATENT DOCUMENTS

| | | | |
|---|---|---|---|
| D. 294,234 | 2/1988 | Lamond | D10/106 |
| D. 305,308 | 1/1990 | Adams et al. | D10/104 |
| D. 307,400 | 4/1990 | Armstrong et al. | D10/106 |
| D. 318,247 | 7/1991 | Shandelman | D10/106 |
| 3,678,608 | 7/1972 | Minasy | 400/20 |
| 3,696,379 | 10/1972 | Minasy | 340/280 |
| 3,711,848 | 1/1973 | Martens | 340/572 |
| 3,859,652 | 1/1975 | Hall et al. | 340/572 |
| 3,868,669 | 2/1975 | Minasy | 340/280 |
| 3,895,368 | 7/1975 | Gordon et al. | 340/258 |
| 3,914,578 | 10/1975 | Bigelow et al. | 235/61.7 |
| 4,063,229 | 12/1977 | Welsh et al. | 340/572 |
| 4,074,249 | 2/1978 | Minasy | 340/280 |
| 4,118,693 | 10/1978 | Novikoff | 340/572 |
| 4,187,509 | 2/1980 | Weiner | 343/873 |
| 4,299,040 | 11/1981 | Minasy | 40/20 |
| 4,299,870 | 11/1981 | Humble | 428/101 |
| 4,309,697 | 1/1982 | Weaver | 340/572 |
| 4,318,090 | 3/1982 | Narlow et al. | 340/572 |
| 4,321,586 | 3/1982 | Cooper et al. | 340/572 |
| 4,326,198 | 4/1982 | Novikoff | 340/572 |
| 4,471,344 | 9/1984 | Williams | 340/572 |
| 4,476,459 | 10/1984 | Cooper et al. | 340/572 |
| 4,531,264 | 7/1985 | Minasy | 24/155 |
| 4,568,921 | 2/1986 | Pokalsky | 341/572 |
| 4,573,042 | 2/1986 | Boyd et al. | 340/539 |
| 4,590,461 | 5/1986 | Cooper | 340/572 |
| 4,595,915 | 6/1986 | Close | 340/572 |
| 4,642,613 | 2/1987 | Pokalsky | 340/572 |
| 4,673,923 | 6/1987 | Boscoe et al. | 340/572 |
| 4,679,035 | 7/1987 | Pfaff et al. | 340/572 |
| 4,684,930 | 8/1987 | Minasy et al. | 340/551 |
| 4,692,747 | 9/1987 | Wolf | 340/572 |
| 4,700,179 | 10/1987 | Fancher | 340/572 |
| 4,720,701 | 1/1988 | Lichtblau | 340/572 |
| 4,727,369 | 2/1988 | Rode et al. | 340/825.31 |

(List continued on next page.)

OTHER PUBLICATIONS

John R. Hayes, "Skipping a Heartbeat," Forbes, Jun. 16, 1997, p. 43.

Detailed view of U.S. Patent No. 3,596,265 available from IBM Patent Server Web Site (http://patent.womplex.ibm.com), 1 page.

Detailed view of U.S. Patent No. 3,665,448 available from IBM Patent Server Web Site (http://patent.womplex.ibm.com), 1 page.

Detailed view of U.S. Patent No. 3,673,765 available from IBM Patent Server Web Site (http://patent.womplex.ibm.com), 3 pages.

(List continued on next page.)

*Primary Examiner*—Daniel J. Wu
*Assistant Examiner*—Toan N. Pham
*Attorney, Agent, or Firm*—Christie, Parker & Hale, LLP

[57] ABSTRACT

An anti-theft detection system. A target comprising a frequency multiplier is affixed to goods in a retail store. A low power radio frequency source is placed near the exits to the retail store, and the target emits harmonics of the frequency transmitted by the radio frequency source when located near the radio frequency source. A detector also located near the exits to the retail store detects the harmonics and commands an alarm, thereby allowing for an apprehension of shoplifters.

18 Claims, 3 Drawing Sheets

U.S. PATENT DOCUMENTS

| | | | |
|---|---|---|---|
| 4,728,938 | 3/1988 | Kaltner | 340/572 |
| 4,736,207 | 4/1988 | Siikarla et al. | 343/895 |
| 4,751,500 | 6/1988 | Minasy et al. | 340/572 |
| 4,751,516 | 6/1988 | Lichtblau | 343/742 |
| 4,769,631 | 9/1988 | Copeland | 340/551 |
| 4,791,412 | 12/1988 | Brooks | 340/572 |
| 4,811,000 | 3/1989 | Humphrey et al. | 340/551 |
| 4,831,363 | 5/1989 | Wolf | 340/572 |
| 4,835,524 | 5/1989 | Lamond et al. | 340/572 |
| 4,866,455 | 9/1989 | Lichtblau | 343/742 |
| 4,870,391 | 9/1989 | Cooper | 340/572 |
| 4,918,416 | 4/1990 | Walton et al. | 235/497 |
| 4,980,670 | 12/1990 | Humphrey et al. | 340/551 |
| 4,987,754 | 1/1991 | Minasy et al. | 70/57.1 |
| 5,012,224 | 4/1991 | Drucker | 340/551 |
| 5,012,225 | 4/1991 | Gill | 340/572 |
| 5,027,106 | 6/1991 | Lizzi et al. | 340/572 |
| 5,029,291 | 7/1991 | Zhou et al. | 340/551 |
| 5,030,940 | 7/1991 | Siikarla | 340/572 |
| 5,030,941 | 7/1991 | Lizzi et al. | 340/572 |
| 5,049,857 | 9/1991 | Plonsky et al. | 340/551 |
| 5,051,726 | 9/1991 | Copeland et al. | 340/572 |
| 5,059,950 | 10/1991 | Perchak | 340/572 |
| 5,059,951 | 10/1991 | Kaltner | 340/572 |
| 5,061,941 | 10/1991 | Lizzi et al. | 343/742 |
| 5,081,445 | 1/1992 | Gill et al. | 340/572 |
| 5,081,446 | 1/1992 | Gill et al. | 340/572 |
| 5,088,165 | 2/1992 | Minas et al. | 24/704.1 |
| 5,103,209 | 4/1992 | Lizzi et al. | 340/572 |
| 5,103,210 | 4/1992 | Rode et al. | 340/572 |
| 5,103,234 | 4/1992 | Watkins et al. | 343/742 |
| 5,103,235 | 4/1992 | Clemens | 343/742 |
| 5,111,186 | 5/1992 | Narlow et al. | 340/572 |
| 5,121,103 | 6/1992 | Minasy et al. | 340/551 |
| 5,126,720 | 6/1992 | Zhou et al. | 340/572 |
| 5,130,697 | 7/1992 | McGinn | 340/551 |
| 5,142,270 | 8/1992 | Appalucci et al. | 340/572 |
| 5,142,292 | 8/1992 | Chang | 343/742 |
| 5,146,204 | 9/1992 | Zhou et al. | 340/551 |
| 5,182,544 | 1/1993 | Aquilera et al. | 340/572 |
| 5,189,397 | 2/1993 | Watkins et al. | 340/572 |
| 5,205,024 | 4/1993 | Willard | 24/704.1 |
| 5,206,626 | 4/1993 | Minasy et al. | 340/572 |
| 5,218,189 | 6/1993 | Hutchison | 235/439 |
| 5,225,807 | 7/1993 | Zhou et al. | 340/551 |
| 5,241,299 | 8/1993 | Appalucci et al. | 340/572 |
| 5,264,829 | 11/1993 | Paul et al. | 340/572 |
| 5,276,431 | 1/1994 | Piccoli et al. | 340/572 |
| 5,278,573 | 1/1994 | Siikarla | 343/749 |
| 5,285,194 | 2/1994 | Ferguson | 340/572 |
| 5,304,983 | 4/1994 | Zhou et al. | 340/572 |
| 5,309,740 | 5/1994 | Hansen | 70/57.1 |
| 5,313,192 | 5/1994 | Ho et al. | 340/551 |
| 5,337,040 | 8/1994 | Kind | 340/572 |
| 5,341,125 | 8/1994 | Plonsky et al. | 340/572 |
| 5,349,332 | 9/1994 | Ferguson et al. | 340/572 |
| 5,351,033 | 9/1994 | Liu et al. | 340/572 |
| 5,353,011 | 10/1994 | Wheeler et al. | 340/572 |
| 5,357,240 | 10/1994 | Sanford et al. | 340/572 |
| 5,367,289 | 11/1994 | Baro et al. | 340/566 |
| 5,373,301 | 12/1994 | Bowers et al. | 343/742 |
| 5,401,584 | 3/1995 | Minasy et al. | 428/611 |
| 5,463,376 | 10/1995 | Stoffer | 340/572 |
| 5,508,684 | 4/1996 | Becker | 340/572 |
| 5,510,769 | 4/1996 | Kajfez et al. | 340/572 |
| 5,510,770 | 4/1996 | Rhoads | 340/572 |
| 5,544,770 | 8/1996 | Travisano | 215/230 |
| 5,574,431 | 11/1996 | McKeown et al. | 340/572 |
| 5,589,820 | 12/1996 | Robinson et al. | 340/572 |
| 5,640,693 | 6/1997 | Balch et al. | 455/127 |
| 5,680,106 | 10/1997 | Schrott et al. | 340/572 |
| 5,699,045 | 12/1997 | Frederick et al. | 340/551 |
| 5,739,754 | 4/1998 | Schrott et al. | 340/572 |

OTHER PUBLICATIONS

Detailed view of U.S. Patent No. 3,713,133 available from IBM Patent Server Web Site (http://patent.womplex.ibm.com), 1 page.
Detailed view of U.S. Patent No. 3,725,895 available from IBM Patent Server Web Site (http://patent.womplex.ibm.com), 1 page.
Detailed view of U.S. Patent No. 3,735,453 available from IBM Patent Server Web Site (http://patent.womplex.ibm.com), 2 pages.
Detailed view of U.S. Patent No. 3,863,245 available from IBM Patent Server Web Site (http://patent.womplex.ibm.com), 2 pages.
Detailed view of U.S. Patent No. 3,900,243 available from IBM Patent Server Web Site (http://patent.womplex.ibm ba.com), 1 page.
Detailed view of U.S. Patent No. 4,123,749 available from IBM Patent Server Web Site (http://patent.womplex.ibm.com), 1 page.
Detailed view of U.S. Patent No. 4,290,524 available from IBM Patent Server Web Site (http://patent.womplex.ibm.com), 1 page.
Detailed view of U.S. Patent No. 4,336,531 available from IBM Patent Server Web Site (http://patent.womplex.ibm.com), 2 pages.
Detailed view of U.S. Patent No. 4,395,600 available from IBM Patent Server Web Site (http://patent.womplex.ibm.com), 2 pages.
Detailed view of U.S. Patent No. 4,481,428 available from IBM Patent Server Web Site (http://patent.womplex.ibm.com), 2 pages.
Detailed view of U.S. Patent No. 4,567,983 available from IBM Patent Server Web Site (http://patent.womplex.ibm.com), 2 pages.
Detailed view of U.S. Patent No. 4,568,921 available from IBM Patent Server Web Site (http://patent.womplex.ibm.com), 1 page.
Detailed view of U.S. Patent No. 4,572,369 available from IBM Patent Server Web Site (http://patent.womplex.ibm.com), 2 pages.
Detailed view of U.S. Patent No. 4,583,083 available from IBM Patent Server Web Site (http://patent.womplex.ibm.com), 2 pages.
Detailed view of U.S. Patent No. 4,603,453 available from IBM Patent Server Web Site (http://patent.womplex.ibm.com), 1 page.
Detailed view of U.S. Patent No. 4,623,062 available from IBM Patent Server Web Site (http://patent.womplex.ibm.com), 2 pages.
Detailed view of U.S. Patent No. 4,819,015 available from IBM Patent Server Web Site (http://patent.womplex.ibm.com), 1 page.
Detailed view of U.S. Patent No. 4,865,190 available from IBM Patent Server Web Site (http://patent.womplex.ibm.com), 1 page.
Detailed view of U.S. Patent No. 4,915,460 available from IBM Patent Server Web Site (http://patent.womplex.ibm.com), 2 pages.
Detailed view of U.S. Patent No. 5,051,727 available from IBM Patent Server Web Site (http://patent.womplex.ibm.com), 1 page.

Detailed view of U.S. Patent No. 5,129,244 available from IBM Patent Server Web Site (http://patent.womplex.ibm.com), 1 page.
Detailed view of U.S. Patent No. 5,188,229 available from IBM Patent Server Web Site (http://patent.womplex.ibm.com), 2 pages.
Detailed view of U.S. Patent No. 5,239,284 available from IBM Patent Server Web Site (http://patent.womplex.ibm.com), 1 page.
Detailed view of U.S. Patent No. 5,254,974 available from IBM Patent Server Web Site (http://patent.womplex.ibm.com), 2 pages.
Detailed view of U.S. Patent No. 5,255,543 available from IBM Patent Server Web Site (http://patent.womplex.ibm.com), 1 page.
Detailed view of U.S. Patent No. 5,312,000 available from IBM Patent Server Web Site (http://patent.womplex.ibm.com), 1 page.
Detailed view of U.S. Patent No. 5,337,040 available from IBM Patent Server Web Site (http://patent.womplex.ibm.com), 1 page.
Detailed view of U.S. Patent No. 5,367,291 available from IBM Patent Server Web Site (http://patent.womplex.ibm.com), 2 pages.
Detailed view of U.S. Patent No. 5,423,436 available from IBM Patent Server Web Site (http://patent.womplex.ibm.com), 2 pages.
Detailed view of U.S. Patent No. 5,424,524 available from IBM Patent Server Web Site (http://patent.womplex.ibm.com), 2 pages.
Detailed view of U.S. Patent No. 5,477,202 available from IBM Patent Server Web Site (http://patent.womplex.ibm.com), 2 pages.
Detailed view of U.S. Patent No. 5,497,639 available from IBM Patent Server Web Site (http://patent.womplex.ibm.com), 1 page.
Detailed view of U.S. Patent No. 5,499,723 available from IBM Patent Server Web Site (http://patent.womplex.ibm.com), 2 pages.
Detailed view of U.S. Patent No. 5,586,657 available from IBM Patent Server Web Site (http://patent.womplex.ibm.com), 1 page.
Detailed view of U.S. Patent No. 5,589,819 available from IBM Patent Server Web Site (http://patent.womplex.ibm.com), 1 page.
Detailed view of U.S. Patent No. 5,618,019 available from IBM Patent Server Web Site (http://patent.womplex.ibm.com), 1 page.
Detailed view of U.S. Patent No. 5,636,535 available from IBM Patent Server Web Site (http://patent.womplex.ibm.com), 3 pages.
Detailed view of U.S. Patent No. D245677 available from IBM Patent Server Web Site (http://patent.womplex.ibm.com), 1 page.
Detailed view of U.S. Patent No. D274297 available from IBM Patent Server Web Site (http://patent.womplex.ibm.com), 1 page.

ANTI-THEFT DETECTION SYSTEM

BACKGROUND OF THE INVENTION

The present invention relates generally to anti-theft detection systems, and more particularly to an anti-theft electronic security system using a frequency multiplier.

Electronic security systems are known for the detection of unauthorized removal of items from stores and other facilities. These detection systems are beneficial in that the presence of such detection systems deters shoplifting theft and allows for the apprehension of those not deterred. These detection systems are found in a variety of locations, including retail stores, particularly those selling clothing, books, videotapes, and the like. The detection system sometimes comprises a magnetic strip attached to a good along with a detector which monitors magnetic fields for determining when the magnetic strip passes through an area proximate the detector. The detection system sometimes also comprises plastic tags attached to clothing and the like, also along with a magnetic field detector. The plastic tags contain a resonant circuit which, when passed through a magnetic field, resonate and disrupt the magnetic field in a detectable manner. Detection systems of this type have been installed in a large number of locations, and are widely used.

These detection systems are not without problems, however. The magnetic strip or tag containing a resonant circuit, both of which may be generally described as a target, is generally attached (and sometimes detached) by a retailer in a labor intensive operation. The targets also are often too large to be accommodated easily by many retail items, or too expensive to justify using with certain items, particularly those found in retail food and drug stores. These detection systems also do not allow for the placement of goods near the detectors as such goods would activate the sensing alarm. This decreases the amount of floor space available for the display of product. These detection systems also are adversely affected by the presence of nearby metallic objects, as well as by noise generators such as laser product scanners and the like. Additionally, there is evidence that some detection systems affect pacemaker operations, and therefore possibly pose health risks to individuals who require the use of a pacemaker.

SUMMARY OF THE INVENTION

The present invention provides an anti-theft detection system utilizing small electronic frequency multipliers. A low power radio frequency source transmitting radio signals at a first frequency is placed near an exit to a retail establishment. Items for sale in the retail establishment are marked with a miniature frequency multiplier. When the frequency multiplier passes by the radio frequency source, a detector detects the harmonics of the first frequency emitted by the frequency multiplier and causes an alarm to issue.

DESCRIPTION OF THE DRAWINGS

Many of the attendant features of this invention will be more readily appreciated as the same become better understood by reference to the following detailed description considered in connection with the accompanying drawings in which like reference symbols designate like parts throughout.

DETAILED DESCRIPTION OF THE INVENTION

Figure 1:
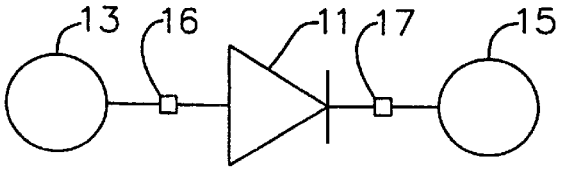
FIG. 1 is a schematic of a target of the present invention.

FIG. 1 illustrates a schematic of a preferred target of the present invention. The target is a harmonic generator, and in the preferred embodiment the target comprises a diode 11. An input antenna 13 is attached to the p-junction of the diode. An output antenna 15 is attached to the n-junction of the diode. The first and second antennae are hair width conductive lines. Diodes, of course, are non-linear devices. Therefore when the diode is provided an input signal at a first frequency the diode generates an output signal with a component at the same frequency as the input signal, along with components at multiples of the frequency of the input signal. Thus, the diode operates as a frequency multiplier, which is a type of harmonic generator.

As with most frequency multipliers, the diode generates multiple harmonics of the input signal, with the higher frequency harmonics being generated to a lesser extent. Thus, when the diode is subject to a radio frequency input signal at a frequency $f_1$, the diode will generate an output signal with components at frequencies $f_1$, $f_2$, $f_3$ . . . $f_N$. Frequency $f_2$ is twice the frequency $f_1$, frequency $f_3$ is three times the frequency $f_1$, and frequency $f_N$ is N times the frequency $f_1$. Generally the power loss at a frequency N times the input frequency is 1/N for a diode frequency multiplier. Therefore the signal strength of the component of the signal at frequency $f_2$ will be significantly larger than the signal strength at frequency $f_3$ . . . $f_N$ for a diode frequency multiplier.

Any number of types of diodes can be used as a frequency multiplier, including tunnel diodes, step recovery diodes (SRDs), and SNAP diodes. A SNAP diode is particularly suited for use in the embedded target. A SNAP diode accumulates current for a short part of each input cycle before suddenly releasing this accumulated current. A transistor or other nonlinear device can also be used as a frequency multiplier, and may be used in place of the diode in the embedded target. Transistors, however, are more expensive than diodes to manufacture. Additionally, transistor power loss at a frequency $f_N$ is $1/N^2$, ignoring transistor current gain, while the diode power loss is only 1/N. Therefore, the use of a diode as the non-linear circuit element is both more economical to manufacture and produces signal harmonics with a larger amplitude.

An observer measuring the output signal generated by the embedded target subject to an input frequency $f_1$ will see an output signal with components at frequency $f_1$ and frequencies $f_2$, $f_3$ . . . $f_N$. If, however, the embedded target is moving with respect to the observer, then the observer would see an output signal with components at $f_{1D}$, $f_{2D}$, $f_{3D}$ . . . $f_{ND}$, where $f_{1D}$, $f_{2D}$, $f_{3D}$ . . . $f_{ND}$ are doppler shifted frequencies $f_{,1}$ $f_{,2}$ . . . $f_{,N}$ Thus, an observer would be able to determine if a non-moving target is within an area subject to an input radio frequency $f_1$ by receiving and measuring signals at frequency $f_2$. The observer would also be able to determine if a moving target is within the area subject to the input radio frequency $f_1$ by receiving and measuring signals at the doppler shifted frequency $f_{2D}$.

Figure 2:
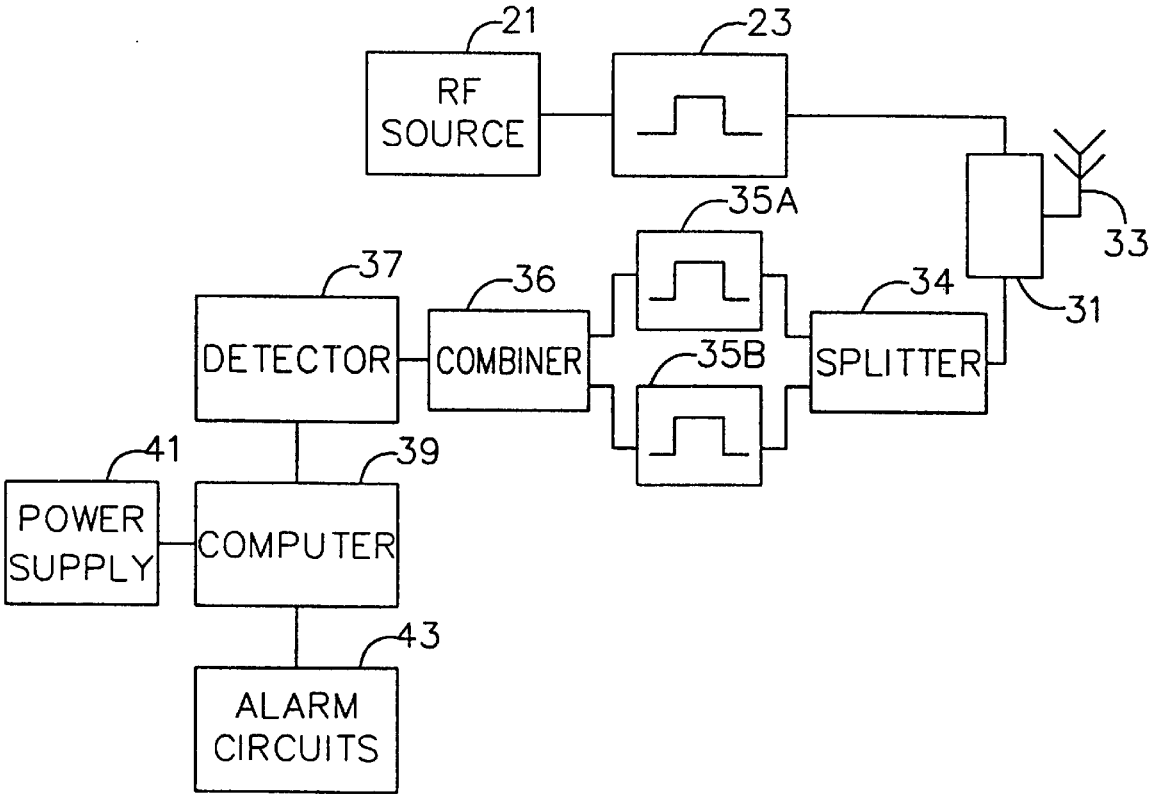
FIG. 2 is a block diagram of an exit gate of the present invention.

FIG. 2 illustrates a block diagram of a preferred exit gate for generating and transmitting an RF signal at frequency $f_1$, and for measuring and processing received RF signals. A low power radio frequency source 21 produces electromagnetic energy at a first frequency $f_1$. $f_1$ is preferably in the gigahertz range to provide for adequate resolution of the signal harmonics and doppler shifted signals. Low power radio frequency sources of this type for radar and other applications are known in the art. These radio frequency sources generally emit signals of a few milliwatts, which is of sufficiently low power that health concerns are not implicated. The signal generated by the RF source is passed through a band pass filter 23. The purpose of the band pass filters is to eliminate components of the signal generated by the RF source at frequencies other than $f_1$, and particularly to reduce the signal strength of any harmonic of $f_1$. The filtered signal is then passed by a duplexer 31 to an antenna 33 for transmission.

The antenna radiates the RF signal over a suitable area such as an area surrounding an exit to a facility. The antenna is of a type suitable for transmitting and receiving radio signals in the gigahertz range, and has no particular lobe pattern. The antenna, however, may be a directional antenna or a specially designed antenna with particular lobe patterns.

The antenna also receives RF signals, although separate input and output antennas may be used to decrease cross-talk and other interference problems. The antenna receives signals at frequency $f_1$ due to reflections from the outgoing signal and signals from antennas of other nearby exit gates. The antenna also receives spurious harmonics not completely filtered by the band pass filters of other exit systems, as well as other spurious electromagnetic signals present in the environment. More importantly, the input antenna receives signals at frequencies $f_1$, $f_2$, $f_3$ . . . $f_N$ from non-moving targets in the reception area of the radio source. Additionally, the input antenna receives signals that are doppler shifted signals at frequencies $f_{1D}$, $f_{2D}$, $f_{3D}$ . . . $f_{ND}$ from moving targets within the reception area. To the extent the radio frequency source emits harmonics of the RF signal at frequency $f_1$, the input antenna also receives signals reflected from non-moving objects at frequencies $f_2$, $f_3$ . . . $f_N$, and signals reflected from moving objects, such as people, at frequencies $f_{2D}$, $f_{3D}$ . . . $f_{ND}$. With frequency $f_1$ in the gigahertz range and a target moving at one meter per second, which may be assumed to be normal walking speed of an average person, the doppler shift is in the range of three to three hundred hertz, depending on the angle between signal propagation and target movement.

The signals received by the antenna are passed to a splitter 34 by the duplexer. The splitter splits the received signals and passes the signals to two band pass filters 35*a,b* arranged in parallel. The first band pass filter 35*a* filters out components of the signals at frequencies other than $f_1$, and the second band pass filter 35*b* filters out components of the signals at frequencies other than those around $f_2$. Because the doppler shifted frequency $f_{2D}$ is close to frequency $f_2$, the second band pass filter allows components of signals at both frequencies $f_2$ and $f_{2D}$ to be passed through. The filtered signals are combined at a combiner 36 and fed to a detector 37. The detector determines the strength of the components of the signals at frequencies $f_1$, $f_2$, and $f_{2D}$. The detector also determines the frequency $f_{2D}$. Values indicative of the signal strength of the components of the signals at these frequencies, as well as a value indicative of frequency $f_{2D}$, are input to a computer 39.

The computer stores in memory values indicative of an expected signal strength of signal components at frequencies $f_1$ and $f_2$ due to the RF source of the detection system. Additionally, the computer stores in memory values indicative of expected signal strength of signal components at frequency $f_{2D}$ for reflective objects and for radiating targets. The computer also stores a running average of the values indicative of received signal strength of the components of the signals at frequencies $f_1$ and $f_2$. The received signal strength of signals at frequencies $f_1$ and $f_2$ are from both the RF source and any nonmoving targets within the reception area. Thus, the computer maintains information pertaining to expected signal levels from the RF source and actual received signal levels, which may include signals from display items placed near the exit gate. With this information and the inputs from the detector of the values indicative of signal strength of the components of signals at frequencies $f_1$, $f_2$, and $f_{2D}$, as well as the value indicative of frequency $f_{2D}$, the computer is able to determine when to activate an alarm circuit 43. Alarm circuits are conventional in the art, and may include flashing lights and audible alarms.

When a target is moved into and through the reception area the value indicative of the received signal strength of the component of the signal at frequency $f_{2D}$ increases. Thus, in the preferred embodiment the computer activates the alarm circuit when an increase in the signal strength at frequency $f_{2D}$ is registered by the computer. In another embodiment, the computer activates the alarm circuit when an increase in the signal strength at frequency $f_{2D}$ approximate the expected signal strength due to a moving target, or an increase other than would occur due to reflection from a moving object, is registered by the computer. In another embodiment, the computer activates the alarm circuit when either an increase in signal strength at frequency $f_1$ or $f_2$, or both, or an increase in signal strength at frequency $f_{2D}$ is registered by the computer. In yet another embodiment, the computer activates the alarm circuit when an increase in signal strength at frequency $f_{2D+}$, with $f_{2D+}$ greater than $f_{2D}$, is first registered, followed by an increase in signal strength at frequency $f_{2D-}$, with $f_{2D-}$ less than $f_{2D}$. Such a pattern of received signal strength is indicative of a target first approaching the exit gate and then moving away from the exit gate. In yet other embodiments, the computer activates the alarm circuit using a combination of the methods described above.

The exit gate additionally has a backup power supply 41 to power the exit gate during periods of interruption of normal power supply circuits, i.e., "blackouts." Because of the low power requirements of the RF source and other components of the detection system a small NiCad or other battery may be used to energize the backup power supply. This allows full system operation during blackouts, thus increasing system operability and versatility.

Figure 3:
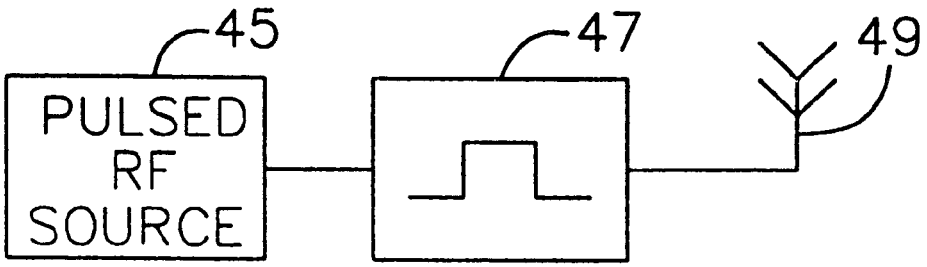
FIG. 3 is a block diagram of a deactivation system of the present invention.

FIG. 3 is a block diagram of a preferred system for deactivating the targets. A pulse source 45 provides a pulsed signal of very short duration at frequency $f_1$. The amplitude of this short duration pulse is sufficient to destroy the pn-junction of the target. Alternately, the pulse source may be used to destroy fusible links 16, 17 (shown in FIG. 1) at the input and output terminals of the diode 11 (also shown in FIG. 1) of the target. As with the RF source of the exit gate, the signal from the RF source of the deactivation system is passed through a band pass filter 47 to reduce the overall signal strength and to eliminate spurious harmonics, particularly those at or about frequency $f_2$. A deactivation antenna 49 for the deactivation system is located within a bar code scanner apparatus (not shown), which are common in retail outlets. The antenna also may be located in a separate hand wand or other movable item.

Figure 4:
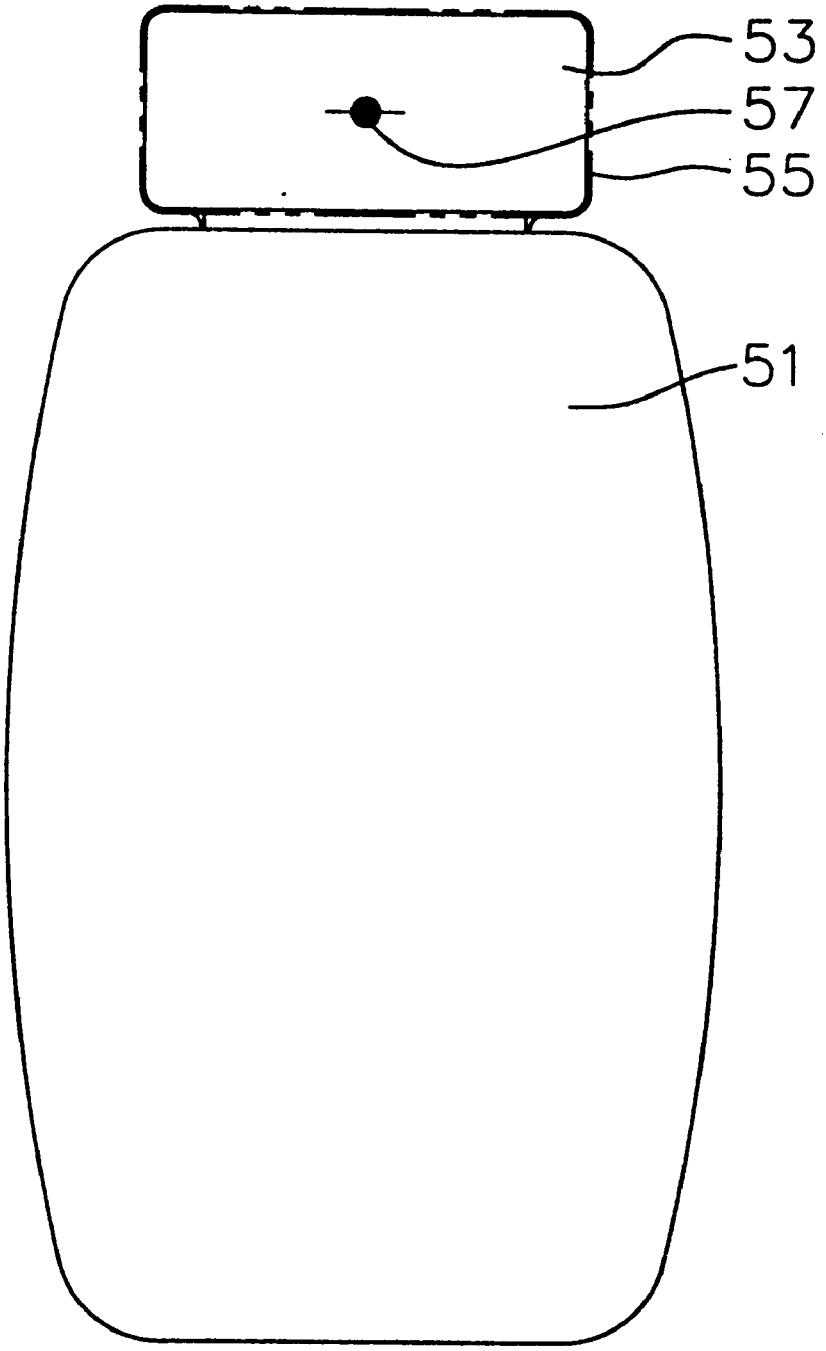
FIG. 4 is a planar view of a product with a target of the present invention affixed to a tamper evident seal.

FIG. 4 shows an embedded target 57 used with a small bottle of aspirin 51. The bottle of aspirin is sealed with a bottle cap 53. The bottle cap and the bottle are further sealed by a tamper evident seal 55. The tamper evident seal is a PVC heat shrinkable band. Tamper evident seals are commonly used with a variety of small retail goods, and the uses of such seals are well known. The circuitry of the target is formed on a substrate. The substrate is then attached to the tamper evident seal by gluing, printing, deposition, or other suitable techniques.

Figure 5:
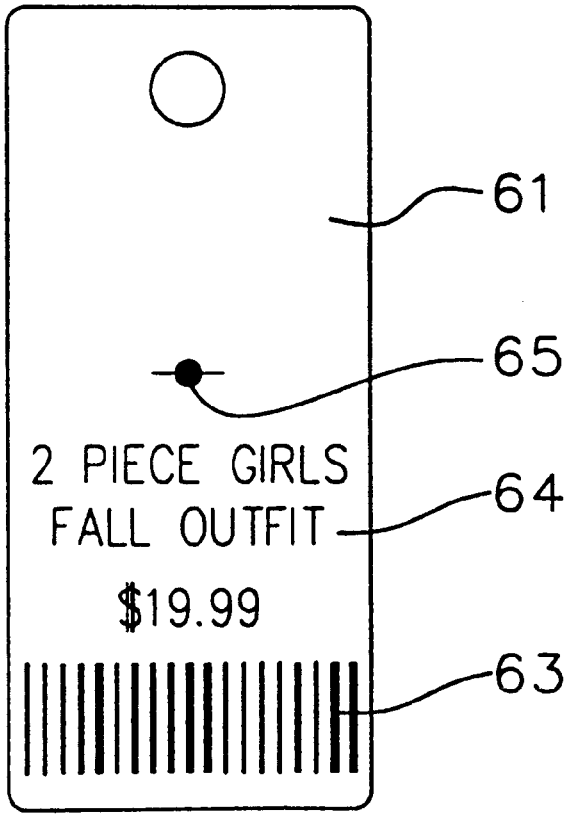
FIG. 5 is a planar view of a sales tag carrying a target of the present invention.

The target may also be applied to a wide variety of items, including a price tag. FIG. 5 illustrates a price tag 61 incorporating the target of the present invention. The price tag has various printed information 64, including bar code information 63, on the price tag. A target 65 is affixed to the price tag. The target may also form part of the bar code information without affecting the usefulness of the bar code. Thus, the target may be applied to price tags, clothing tags, and a variety of other items. The target may be hidden in a variety of ways on many of these items due to the small size of the target, and potential shoplifters will be deterred by being unable to determine with certainty whether a target is present on any one item.

Thus, the anti-theft detection system of the present invention provides a simple and adaptable system of anti-theft control. The low power output signal of the exit gate presents a minimal health risk, and the target provides a small and economical theft control marker. Although this invention has been described in certain specific embodiments, many additional modifications and variations will be apparent to those skilled in the art. It is therefore to be understood that this invention may be practiced otherwise unless specifically described. Thus, the present embodiments in the invention should be considered in all respects as illustrative and not restrictive, the scope of the invention to be indicated by the appended claims rather than the foregoing description.

We claim:

1. An anti-theft detection system comprising:

a radio frequency source emitting a source signal at a first frequency;

a target which outputs a target signal with a component at a second frequency when subject to the signal at the first frequency;

a detector for detecting the component of the target signal at the second frequency and for detecting a component of a doppler shifted target signal approximate the second frequency;

an alarm activated when the detector detects both the component of the target signal at the second frequency and the component of the doppler shifted target signal approximate the second frequency;

the target comprising a frequency multiplier;

the first frequency is a frequency $f_1$ and the second frequency is a frequency is $f_2$, and $f_2$ is a multiple of $f_1$;

wherein the detector detects signals at frequencies approximate frequency $f_2$, the signals at frequencies approximate frequency $f_2$ being doppler shifted signals of signals at frequency $f_2$;

an alarm processor, the alarm processor receiving signal level information from the detector;

wherein the alarm processor commands the alarm when the alarm processor determines that the detector has detected both the component of the target signal at frequency $f_2$ and the component of the doppler shift target signal approximate $f_2$;

wherein the alarm processor stores predefined values indicative of signal strength at frequencies $f_1$,$f_2$ and doppler shifted frequencies of $f_2$, and the alarm processor commands the alarm when the alarm processor determines that the detector has detected an increase in signal strength above the values indicative of signal strength at frequencies $f_1$, $f_2$, and doppler shifted frequencies of $f_2$.

2. The anti-theft detection system of claim 1 wherein the target comprises a diode.

3. The anti-theft detection system of claim 2 wherein the diode has an input antenna attached to an input of the diode and an output antenna attached to an output of the diode.

4. The anti-theft detection system of claim 3 wherein the input antenna includes a fusible link.

5. The anti-theft detection system of claim 4 wherein the output antenna includes a fusible link.

6. The anti-theft detection system of claim 3 wherein the frequency multiplier is attached to a tamper evident seal.

7. The anti-theft detection system of claim 6 wherein the tamper evident seal comprises a heat shrinkable band.

8. The anti-theft detection system of claim 7 wherein the heat shrinkable band is composed of a polyvinylchloride material.

9. The anti-theft detection system of claim 3 wherein the frequency multiplier is attached to a price tag.

10. An anti-theft detection system comprising:

a radio frequency source emitting a source signal at a first frequency;

a target which outputs a target signal with a component at a second frequency when subject to the signal at the first frequency;

a detector for detecting a component of a doppler shifted target signal approximate the second frequency;

an alarm activated when the detector detects the component of the doppler shifted target signal approximate the second frequency with the alarm not being activated solely by detection by the detector of a component of the target signal at the second frequency;

the target comprising a frequency multiplier;

the first frequency is a frequency $f_1$ and the second frequency is a frequency $f_2$, and $f_2$ is a multiple of $f_1$;

wherein the detector detects signals at frequencies approximate frequency $f_2$, the signals at frequencies approximate frequency $f_2$ being doppler shifted signals of signals at frequency $f_2$;

an alarm processor, the alarm processor receiving signal level information from the detector;

wherein the alarm processor commands the alarm when the alarm processor determines that the detector has detected the component of the doppler shifted target signal approximate $f_2$; and wherein the alarm processor stores predefined values indicative of signal strength at doppler shifted frequencies of $f_2$, and the alarm processor commands the alarm when the alarm processor determines that the detector has detected an increase in signal strength above the values indicative of signal strength at doppler shifted frequencies of $f_2$.

11. The anti-theft detection system of claim 10 wherein the target comprises a diode.

12. The anti-theft detection system of claim 11 wherein the diode has an input antenna attached to an input of the diode and an output antenna attached to an output of the diode.

13. The anti-theft detection system of claim 12 wherein the input antenna includes a fusible link.

14. The anti-theft detection system of claim 13 wherein the output antenna includes a fusible link.

15. The anti-theft detection system of claim 12 wherein the diode is attached to a tamper evident seal.

16. The anti-theft detection system of claim 15 wherein the tamper evident seal comprises a heat shrinkable band.

17. The anti-theft detection system of claim 16 wherein the heat shrinkable band is composed of polyvinylchloride material.

18. The anti-theft detection system of claim 12 wherein the frequency multiplier is attached to a price tag.

* * * * *